US006507251B2

(12) United States Patent
Mizoguchi et al.

(10) Patent No.: US 6,507,251 B2
(45) Date of Patent: Jan. 14, 2003

(54) DUAL-MODE BAND-PASS FILTER

(75) Inventors: Naoki Mizoguchi, Shiga-ken (JP); Hisatake Okamura, Nagaokakyo (JP); Seiji Kamba, Kusatsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/954,996

(22) Filed: Sep. 18, 2001

(65) Prior Publication Data

US 2002/0033743 A1 Mar. 21, 2002

(30) Foreign Application Priority Data

Sep. 19, 2000 (JP) ..... 2000-283700
Jul. 23, 2001 (JP) ..... 2001-221857

(51) Int. Cl.[7] ..... H01P 1/213; H01P 1/203

(52) U.S. Cl. ..... 333/134; 333/204; 333/135; 333/202; 333/207; 333/126; 333/235; 333/208; 333/209; 333/212; 333/185; 333/219.1; 333/132; 333/110

(58) Field of Search ..... 333/134, 185, 333/202, 207, 204, 219.1, 126, 235, 132, 110, 208, 212, 135, 209

(56) References Cited

U.S. PATENT DOCUMENTS 5,369,383 A * 11/1994 Takahashi et al. ..... 333/204
5,410,284 A * 4/1995 Jachowski ..... 333/202
5,493,258 A * 2/1996 Parker ..... 333/134
5,525,945 A * 6/1996 Chiappetta et al. ..... 333/219.1
5,541,560 A * 7/1996 Turunen et al. ..... 333/134
5,930,266 A * 7/1999 Ramsey et al. ..... 333/110
6,011,959 A * 1/2000 Reeser et al. ..... 333/134
6,031,436 A * 2/2000 Fiedziuszko et al. ..... 333/202
6,108,569 A * 8/2000 Shen ..... 333/134
6,178,339 B1 * 1/2001 Sakai et al. ..... 333/134
6,255,914 B1 * 7/2001 Ishikawa et al. ..... 333/134
6,326,865 B1 * 12/2001 Kundu et al. ..... 333/134
6,370,404 B1 * 4/2002 Shen ..... 333/134

FOREIGN PATENT DOCUMENTS

JP 06-112701 4/1994
JP 09-139612 5/1997
JP 09-162610 6/1997

OTHER PUBLICATIONS

Curtis, J.A. and Fiedziuszko, S.J.; "Miniature Dual Mode Microstrip Filters"; 1991; 1991 IEEE MTT–S Digest; pp. 443–446.

* cited by examiner

*Primary Examiner*—Michael Tokar
*Assistant Examiner*—Lam T. Mai
(74) *Attorney, Agent, or Firm*—Keating & Bennett, LLP

(57) ABSTRACT

In a dual-mode bandpass filter, a metal film is partially formed on one surface of a dielectric substrate or at a certain vertical level within the dielectric substrate, first and second input/output coupling circuits are coupled to the metal film, at least one capacitor is loaded to the metal film so that when an input signal is applied from either input/output coupling circuit, two resonant modes generated in the metal film are coupled. The capacitor preferably includes via-hole electrodes opposing the metal film.

19 Claims, 12 Drawing Sheets

DUAL-MODE BAND-PASS FILTER

BACKGROUND OF THE INVENTION

1. Field of the Invention

The present invention relates to a dual-mode bandpass filter for use in, for example, communication apparatuses for microwave to milliwave bands.

2. Description of the Related Art Conventionally, various dual-mode bandpass filters have been proposed as bandpass filters for use in high frequency ranges (MINIATURE DUAL MODE MICROSTRIP FILTERS, J. A. Curtis and S. J. Fiedziuszko, 1991 IEEE MTT-S Digest).

FIGS. 22 and 23 are schematic plane figures illustrating conventional dual-mode bandpass filters.

In the bandpass filter 200 shown in FIG. 22, a circular conductive film 201 is disposed on a dielectric substrate (not shown). An input/output coupling circuit 202 and an input/output coupling circuit 203 are coupled to the conductive film 201 so as to be arranged at 90 degrees with respect to each other. An end-open stub 204 is provided at a position having a central angle of 45 degrees with respect to a portion having the input/output coupling circuit 203. This arrangement couples two resonant modes having different resonant frequencies, so that the bandpass filter 200 can operate as a dual-mode bandpass filter.

In the dual-mode bandpass filter 210 shown in FIG. 23, a substantially square conductive film 211 is disposed on a dielectric substrate. Input/output circuits 212 and 213 are coupled to the conductive film 211 to define an angle of 90 degrees with respect to each other. Also, a corner portion at a 135-degree position with respect to the input/output coupling circuit 213 is cut out. By providing a cutout portion 211*a*, the resonant frequencies of two resonant modes are made different, so that the coupling of the resonance in the two modes allows the bandpass filter 210 to operate as a dual-mode bandpass filter.

In addition, instead of the circular conductive film, a dual mode filter using a ring conductive film has been proposed (Japanese Unexamined Patent Application Publication Nos. 9-139612, 9-162610). In other words, a dual mode filter is disclosed in which a ring transmission path is used, input/output coupling circuits are arranged so as to define a central angle of 90 degrees, and an end-open stub is provided on part of the ring transmission path.

According to the conventional dual-mode bandpass filters shown in FIGS. 22 and 23, by forming one conductive film pattern, a two-stage bandpass filter can be formed, which can accordingly achieve an overall size reduction of the bandpass filter.

Nevertheless, the circular and square conductive film patterns have defects in that a broad pass band cannot be obtained because the patterns have a structure in which input/output coupling circuits are coupled with the above-described specific angle defined therebetween and the degree of coupling cannot be increased.

The shape of each bandpass filter is limited such that the conductive film 201 in the bandpass filter shown in FIG. 22 is circular and the conductive film 211 in the bandpass filter shown in FIG. 23 is substantially square. Accordingly, there is also a problem in that a degree of freedom in design is very low.

In the above-described bandpass filters, the dimensions and other characteristics of the conductive film determine the frequency band, so that it is difficult to adjust the band.

SUMMARY OF THE INVENTION

In order to overcome the problems described above, preferred embodiments of the present invention provide a dual-mode bandpass filter in which the above-described defects in the related art are eliminated, significant size reduction is achieved, and broadening of the band is achieved, while providing a high degree of design freedom.

According to a preferred embodiment of the present invention, a dual-mode bandpass filter includes a dielectric substrate having a pair of main surfaces, a metal film disposed on one of the main surfaces of the dielectric substrate or at a level within the dielectric substrate, a ground electrode disposed in the dielectric substrate or on one of the main surfaces of the dielectric substrate so as to oppose the metal film, with at least a portion of the dielectric substrate provided therebetween, first and second input/output coupling circuits coupled to the metal film, and at least one capacitor loaded to the metal film so that when an input signal is applied from one of the first and second input/output coupling circuits, two resonant modes generated in the metal film are coupled.

Preferably, the capacitor is provided in a portion of the metal film in which a resonant electric field that is relatively stronger than that of the remaining portion is generated.

The capacitor may include a capacitance lead-out electrode which is connected to the ground electrode and which is disposed in the dielectric substrate, and the layer of the dielectric substrate and the capacitance lead-out electrode and the metal film may have a capacitance therebetween.

The capacitance lead-out electrode may include a via hole electrode.

The capacitance lead-out electrode may further include a counter-electrode film that is disposed at an end of the via hole electrode and that is disposed in the dielectric substrate so as to oppose the metal film.

The plane shape of the metal film may be substantially rectangular, substantially rhombic, or substantially polygonal, or other suitable shape.

According to a dual-mode bandpass filter of preferred embodiments of the present invention, first and second input/output coupling circuits are coupled to a metal film that is partially formed on one of the main surfaces of a dielectric substrate or in the dielectric substrate. When an input voltage is applied from the first or second input/output coupling circuits, two resonant modes are generated in the metal film. Since at least one capacitor is loaded to the metal film so that the two resonant modes are coupled, a dual-mode-bandpass-filter operation is performed. In contrast to a conventional dual-mode bandpass filter in which points where the input/output coupling circuits are coupled must be disposed with respect to the metal film, which has a particular plane shape of circle or square, so as to define a central angle of 90 degrees, in the dual-mode bandpass filter of various preferred embodiments of the present invention, the presence, arrangement and function of the capacitance achieves the coupling of two resonant modes. Thus, the points at which the input/output coupling circuits are coupled do not always need to be arranged with respect to the metal film so as to define a central angle of 90 degrees.

In addition, by adjusting the capacitance and arranging the position of the capacitor, the bandwidth can easily be adjusted.

Accordingly, in preferred embodiments of the present invention, a bandpass filter can be provided in which a degree of design freedom is very high and a desired bandwidth can easily be obtained.

When an area in which the capacitor is provided is a portion of the metal film in which a resonant electric field that is relatively stronger than that of the other portion is generated, the two resonant modes are coupled such that in either resonant mode, a resonant electric field in the metal film portion in which the strong resonant field is generated is weakened by the provision of the capacitor.

In the case of the structure in which the capacitor includes a capacitance lead-out electrode being connected to a ground electrode and being disposed in the dielectric substrate and in which capacitance is led from the layer of the dielectric substrate between the capacitance lead-out electrode and the metal film, by adjusting the area of the capacitance lead-out electrode, the bandwidth can easily be adjusted. Also, a capacitor can easily be disposed in the dielectric substrate by using layered-ceramic-electronic-component production technology, which can further contribute to size reduction of the dual-mode bandpass filter.

In a case in which the capacitance lead-out electrode is a via hole electrode, the capacitance lead-out electrode can easily be formed by using a multi-layered ceramic substrate production method.

In a case in which the capacitance lead-out electrode includes a via hole electrode, and a counter-electrode film provided in the dielectric substrate so as to oppose the metal film, with a layer of the dielectric substrate provided therebetween, by adjusting the area of the counter-electrode film, the capacitance of the provided capacitor can easily be adjusted by a large amount.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

With reference to the drawings, by describing specific dual-mode bandpass filters according to preferred embodiments of the present invention, the present invention will be made clear.

Figure 1:
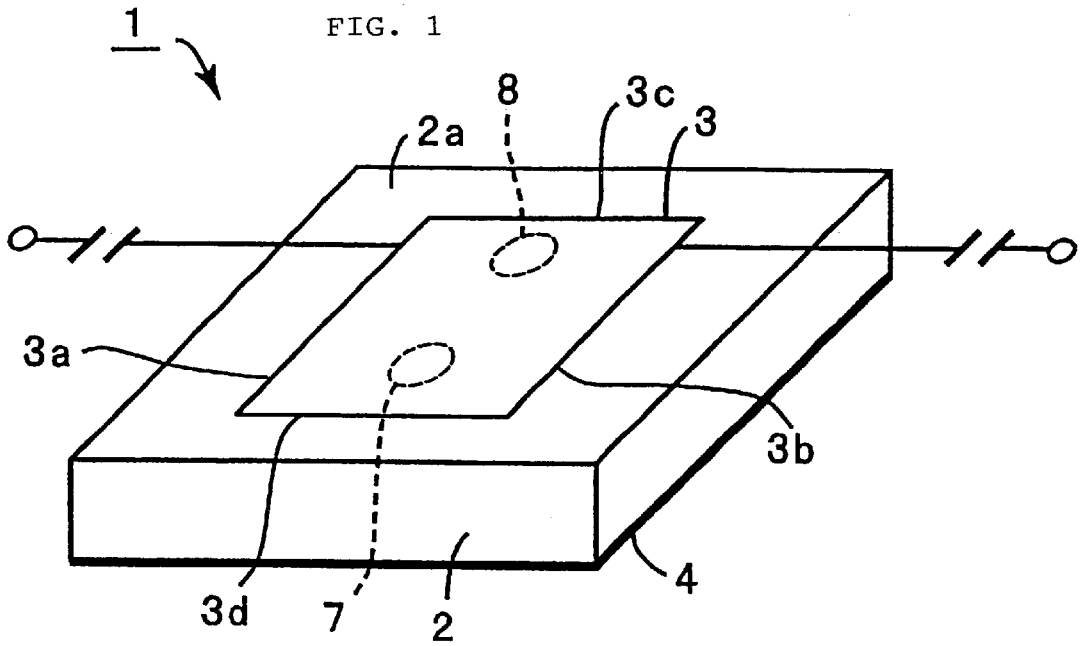
FIG. 1 is a perspective view of a dual-mode bandpass filter according to a first preferred embodiment of the present invention.
Figure 2:
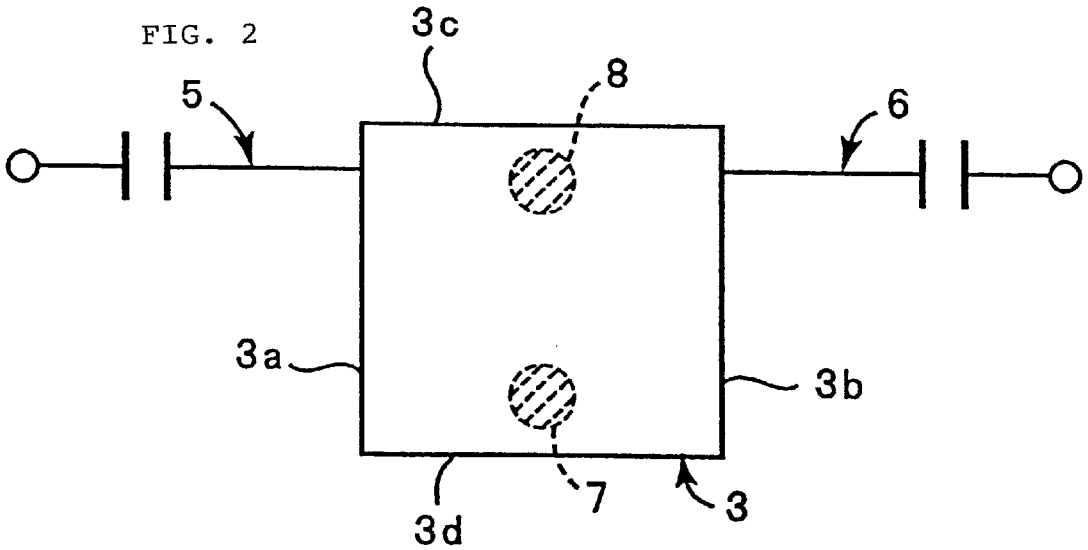
FIG. 2 is a schematic plane figure showing the main portion of a dual-mode bandpass filter according to a first preferred embodiment of the present invention.

FIG. 1 is a perspective view illustrating a dual-mode bandpass filter according to a first preferred embodiment of the present invention, and FIG. 2 is a schematic plane figure showing the main portion of the dual-mode bandpass filter.

A dual-mode bandpass filter 1 preferably has a substantially rectangular dielectric substrate 2. In the first preferred embodiment, the dielectric substrate 2 is preferably made of ceramic material having a dielectric constant $\in r=6.27$, which chiefly has oxides of Ba, Al, and Si. In addition, in the first preferred embodiment and the following preferred embodiments, concerning dielectric material for the dielectric substrate 2, appropriate dielectric materials such as other types of ceramic material and synthetic resins such as fluoroplastics can be used.

The thickness of the dielectric substrate 2 is not particularly limited, but is preferably about 300 $\mu$m in the first preferred embodiment.

On the upper surface 2*a* of the dielectric substrate 2, a substantially rectangular metal film 3 is disposed to constitute a resonator. The substantially rectangular metal film 3 is partially formed on the upper surface 2*a* of the dielectric substrate 2, and has an exterior substantially square shape having dimensions of about 2.0 mm by about 2.0 mm in the first preferred embodiment.

Conversely, on the lower surface of the dielectric substrate 2, a ground electrode 4 is arranged to cover the entire surface thereof, so as to oppose the metal film 3, with the dielectric substrate 2 disposed therebetween.

Input/output coupling circuits S and 6 are arranged relative to the metal film 3, with predetermined gaps provided therebetween. In the first preferred embodiment, the input/output coupling circuits 5 and 6 are preferably defined by a pair of opposite sides 3*a* and 3*b* of the metal film 3 on the upper surface of the dielectric substrate 2 and metal films provided across predetermined gaps, although details are not particularly shown. In other words, the input/output coupling circuits 5 and 6 are coupled to the metal film 3 so as to generate capacitance.

Figure 3:
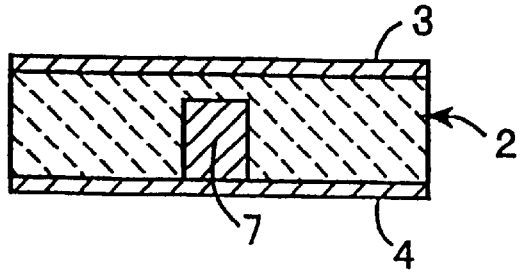
FIG. 3 is a sectional drawing of the main portion of a dual-mode bandpass filter according to the first preferred embodiment of the present invention.

As indicated by the broken lines in FIGS. 1 and 2, on the lower surface of the metal film 3, via hole electrodes 7 and 8 are provided as capacitance lead-out electrodes so as to be substantially perpendicular to the metal film 3. As FIG. 3 shows the main portion in a sectional view, the via hole electrode 7 upwardly extends from the lower surface of the dielectric substrate 2, and the lower end of the via hole electrode 7 is electrically connected to the ground electrode 4. The upper end of the via hole electrode 4 is opposed to the metal film 3, with a dielectric substrate layer provided therebetween. Also, the via hole electrode 8 is similarly formed. Accordingly, capacitors are disposed between the metal film 3 and the via hole electrodes 7 and 8, so that capacitance generated by these capacitors is applied to the metal film 3.

In the first preferred embodiment, the upper surfaces of the via hole electrodes 7 and 8 are each preferably formed to have a substantially circular shape having a diameter of about 300 $\mu$m. Both end surfaces of the via hole electrodes, specifically, the planar shapes of the portions opposed to the metal film 3 may not only be substantially circular but also may have an arbitrary shape such as a square.

The thickness of the dielectric substrate layer between the via hole electrodes 7 and 8, and the metal film 3 is preferably about 100 $\mu$m.

In the first preferred embodiment, by applying an input voltage between one of the input/output coupling circuits 5 and 6 and the ground electrode 4, an output is led between the other one of the input/output coupling circuits 5 and 6 and the ground electrode 4. In this case, in the metal film 3, two resonant modes are generated which have different resonant frequencies and which propagate in a direction of joining points to which the input/output coupling circuits 5 and 6 are coupled and in a direction that is substantially perpendicular thereto. In the first preferred embodiment, the via hole electrodes 7 and 8 provide the metal film 3 with capacitance, and the via hole electrodes 7 and 8 are disposed so that the two resonant modes are coupled. Accordingly, the coupling between the resonant modes generated in the metal film 3 enables a dual-mode bandpass-filter operation.

To couple the two resonant modes generated in the metal film 3, the resonant frequency of one mode may be positioned so that both modes can be coupled. In the first preferred embodiment, the two resonant modes are coupled by arranging the via hole electrodes 7 and 8 so as to weaken a resonant electric field in a portion having a strong resonant electric field of a resonant mode propagating in a direction coupling the sides 3*a* and 3*b*.

Figure 5:
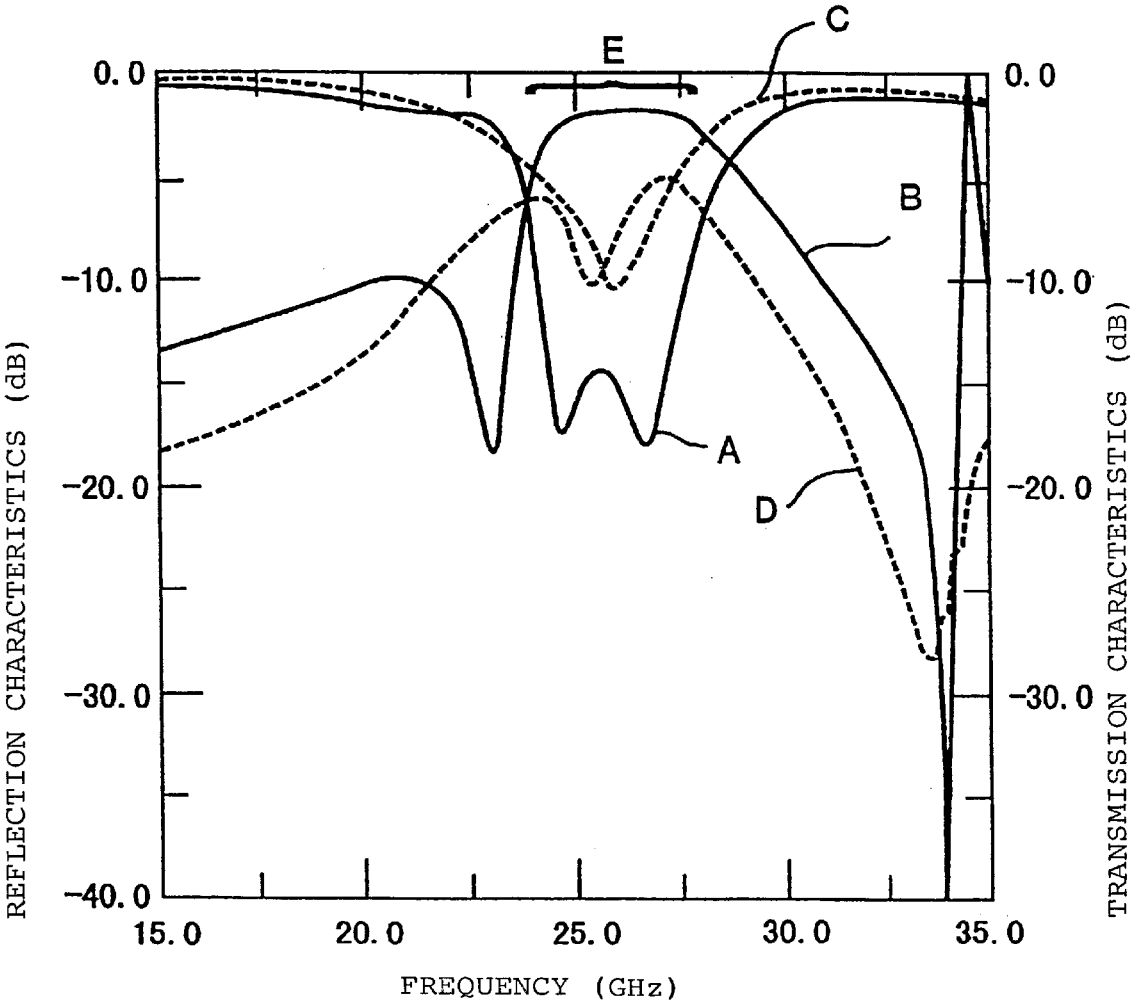
FIG. 5 is a graph showing the frequency characteristics of the first preferred embodiment and a comparative example.

FIG. 5 is a graph showing the frequency characteristics of a comparative example similar to the first preferred embodiment, except that the frequency characteristics of the dual-mode bandpass filter 1 according to the first preferred embodiment and the via hole electrodes 7 and 8 are not provided. In FIG. 5, the solid line A indicates the reflection characteristics of the first preferred embodiment, the solid line B indicates the pass characteristics of the first preferred embodiment, the broken line C indicates the reflection characteristics of the comparative example, and the broken line D indicates the pass characteristics of the comparative example. As is clear from FIG. 5, in the comparative example in which the via hole electrodes 7 and 8 are not provided, two resonant modes are not coupled, so that an effective bandwidth cannot be obtained. Conversely, it is understood that in the dual-mode bandpass filter according to the first preferred embodiment, the resonant modes are coupled to form the pass band denoted by E.

In the first preferred embodiment, the first capacitance lead-out electrode is preferably defined by the via hole electrode 7. However, as shown in the modification in FIG. 4, a counter electrode film 9 may be disposed at a position in the height of a dielectric substrate 2. In the structure shown in FIG. 4, the lower surface of the counter electrode 9 is connected to the via hole electrode 7, and the lower end of the via hole electrode 7 is connected to the ground electrode 4. In other words, the via hole electrode 7 functions to electrically connect the counter electrode film 9 to the ground electrode 4.

Figure 4:
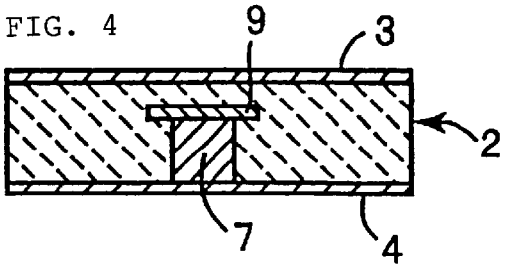
FIG. 4 is a main-part sectional drawing illustrating a dual-mode bandpass filter according to the first preferred embodiment of the present invention.

The planar shape of the counter electrode film 9 that combines with the via hole electrode 7 to define the capacitance lead-out electrode is not particularly limited, but can have various shapes such as quadrangle, circle, and polygons other than quadrangle. By providing the counter electrode film 9 in addition to the via hole electrode 7, as shown in FIG. 4, a larger capacitance can be applied to the metal film 3.

As is clear from the first preferred embodiment of the present invention, the present inventors have discovered that by providing the metal film 3 with capacitance, the two resonant modes generated in the metal film 3 are coupled to form a bandpass filter.

Figure 6:
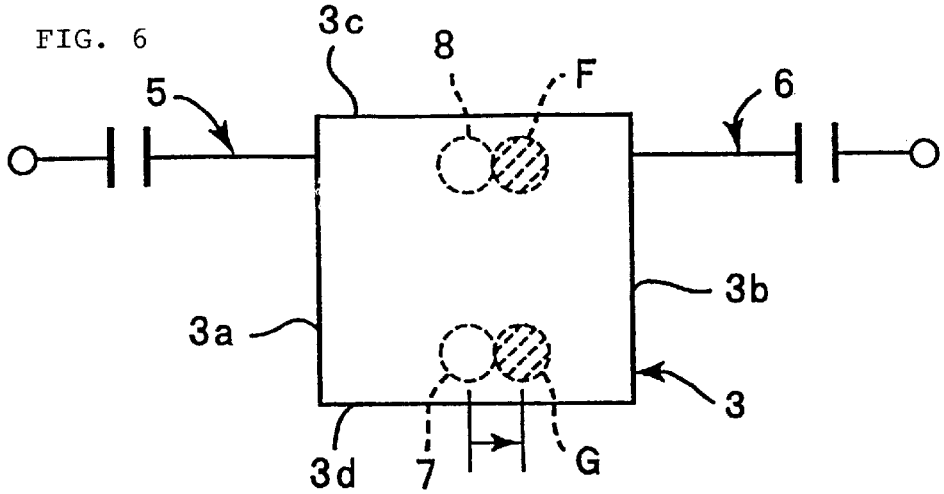
FIG. 6 is a schematic plane figure illustrating the structure of a dual-mode bandpass filter according to the first preferred embodiment in which the positions of the capacitors are changed.

Accordingly, it was studied how the frequency characteristics change when the positions of the via hole electrodes 7 and 8 are moved. Specifically, as shown in the schematic plane figure of FIG. 6, two types of dual-mode bandpass filters were produced, with the positions of the via hole electrodes 7 and 8 moved about 100 $\mu$m or about 200 $\mu$m toward a side 3*b*, as denoted by broken lines F and G. The frequency characteristics of the thus obtained dual-mode bandpass filters of the two types, and the frequency characteristics of the dual-mode bandpass filter according to the first preferred embodiment are shown in FIG. 7.

Figure 7:
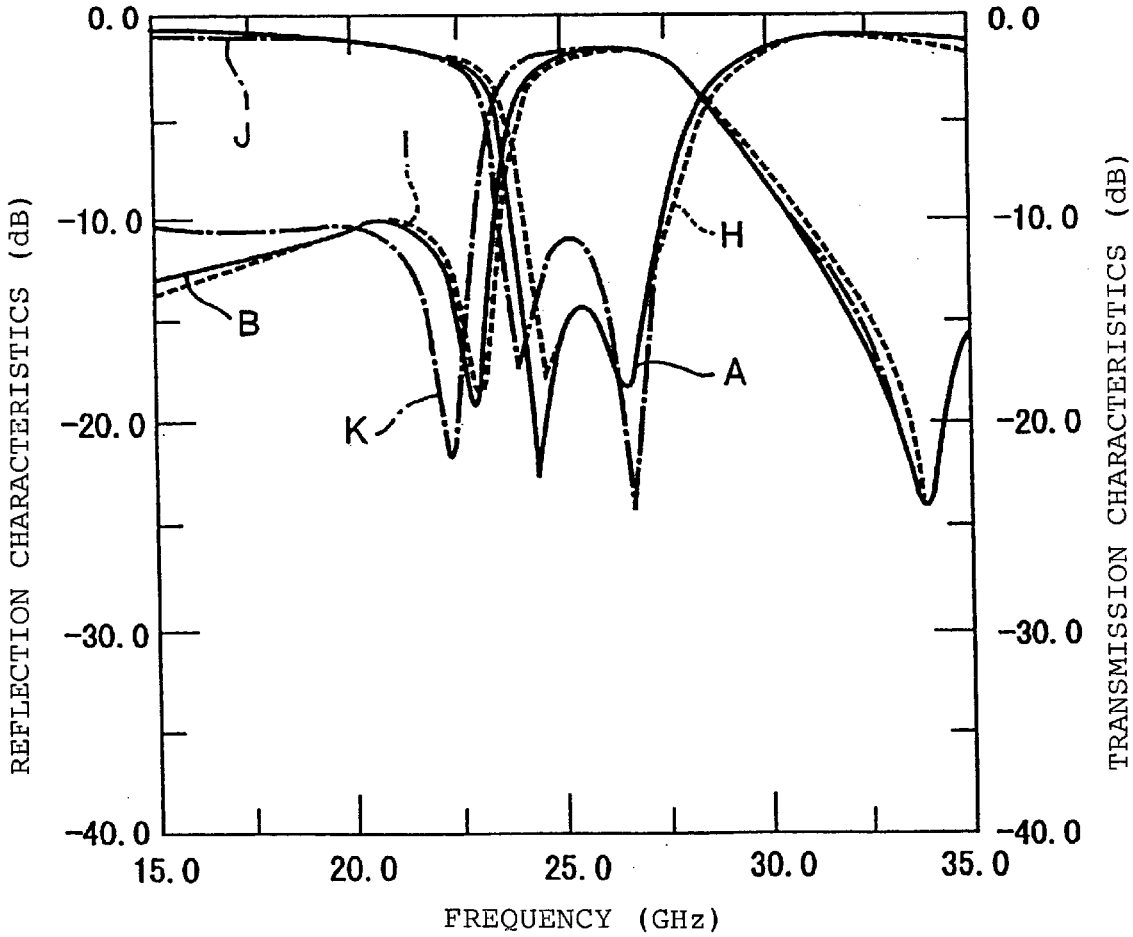
FIG. 7 is a graph showing changes in frequency characteristics in a case in which, in the first preferred embodiment, the positions of capacitors are changed.

In FIG. 7, solid line A indicates the reflection characteristics of the first preferred embodiment, solid line B indicates the pass characteristics of the first preferred embodiment, broken line H and broken line I each indicate reflection characteristics and pass characteristics obtained when the via hole electrodes are moved about 100 $\mu$m, and chain lines J and K indicate reflection characteristics and pass characteristics obtained when the positions of the via hole electrodes 7 and 8 are moved about 200 $\mu$m.

As is clear from FIG. 7, it is understood that by moving the positions of the via hole electrodes 7 and 8, the resonant frequency of one resonant mode among the two resonant modes is shifted to enable the bandwidth to be adjusted.

Figure 8:
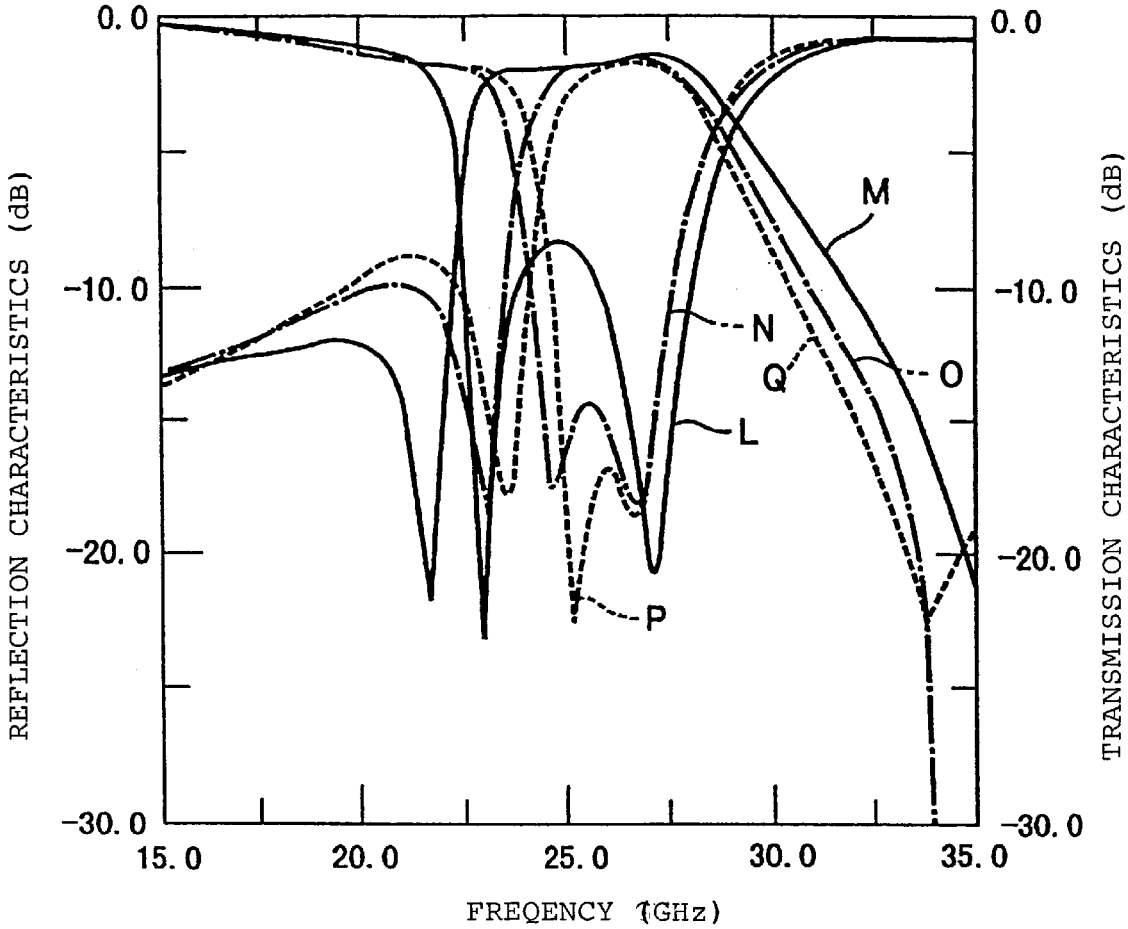
FIG. 8 is a graph showing changes in frequency characteristics in a case in which in a dual-mode bandpass filter according to the first preferred embodiment, the diameter of each via hole electrode defining a capacitor is changed.

In FIG. 8, frequency characteristics are shown which are obtained in each of cases in which the diameter of the upper end surface of each via hole electrode is changed to approximately 180 $\mu$m, 200 $\mu$m, and 230 $\mu$m. In FIG. 8, solid lines L and M indicate reflection characteristics and pass characteristics obtained when the diameter of each via hole electrode is approximately 230 $\mu$m, chain lines N and O indicate reflection characteristics and pass characteristics obtained when the diameter of each via hole electrode is approximately 200 $\mu$m, and broken lines P and Q indicate reflection characteristics and pass characteristics obtained when the diameter of the via hole electrode 7 or 8 is approximately 180 $\mu$m.

As is clear from FIG. 8, it is understood that when the diameter of the via hole electrode 7 or 8 is changed, in other words, by changing the magnitude of a capacitance led between the metal film 3 and the via hole electrodes 7 and 8, the resonant frequency of one resonant mode among the two resonant modes changes enabling the bandwidth to be adjusted.

As is clear from the results in FIGS. 7 and 8, it is understood that in the dual-mode bandpass filter according to the first preferred embodiment, for providing the metal film 3 with capacitance for coupling resonant modes having different resonant frequencies, the pass-band width can easily be adjusted by changing the position of the capacitance lead-out electrode and the magnitude of the capacitance.

Since in the first preferred embodiment the dual-mode bandpass filter is formed by providing the metal film 3 with capacitance so that the two resonant modes are coupled, each of positions at which the input/output coupling circuits 5 and 6 are coupled to the metal film 3 do not always need to have a central angle of 90 degrees with respect to the center of the metal film as is required in the conventional devices. Accordingly, the degree of design freedom of dual-mode bandpass filters is greatly increased and a dual-mode bandpass filters having desired bandwidth are easily produced.

Figure 9:
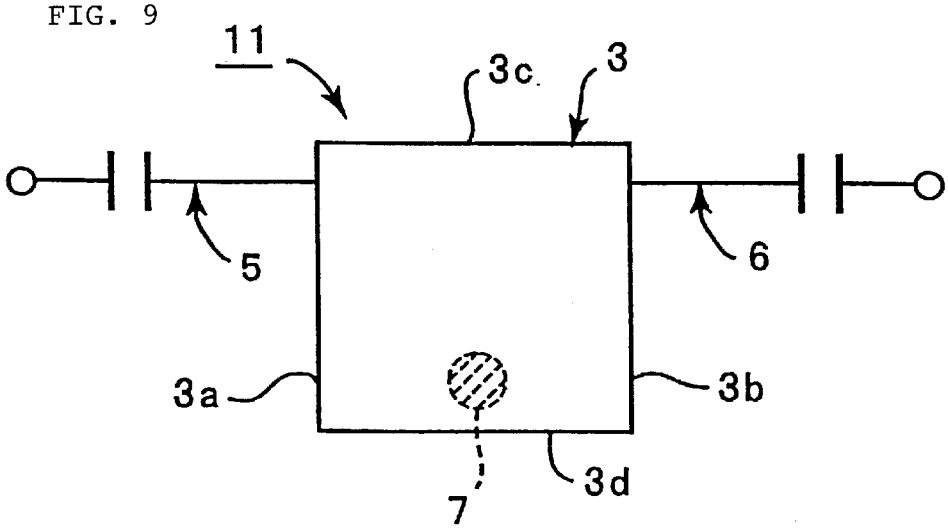
FIG. 9 is a schematic plane figure showing the main portion of a dual-mode bandpass filter according to a second preferred embodiment of the present invention.

FIG. 9 is a schematic plane figure illustrating a dual-mode bandpass filter according to a second preferred embodiment of the present invention and corresponds to FIG. 2 showing the first preferred embodiment.

In a dual-mode bandpass filter 11 according to the second preferred embodiment, the capacitor provided to the metal film 3 is only one capacitor defined by a via hole electrode 7. In other words, the second preferred embodiment is similar to the first preferred embodiment, except that the via hole electrode 8 is not provided.

Figure 10:
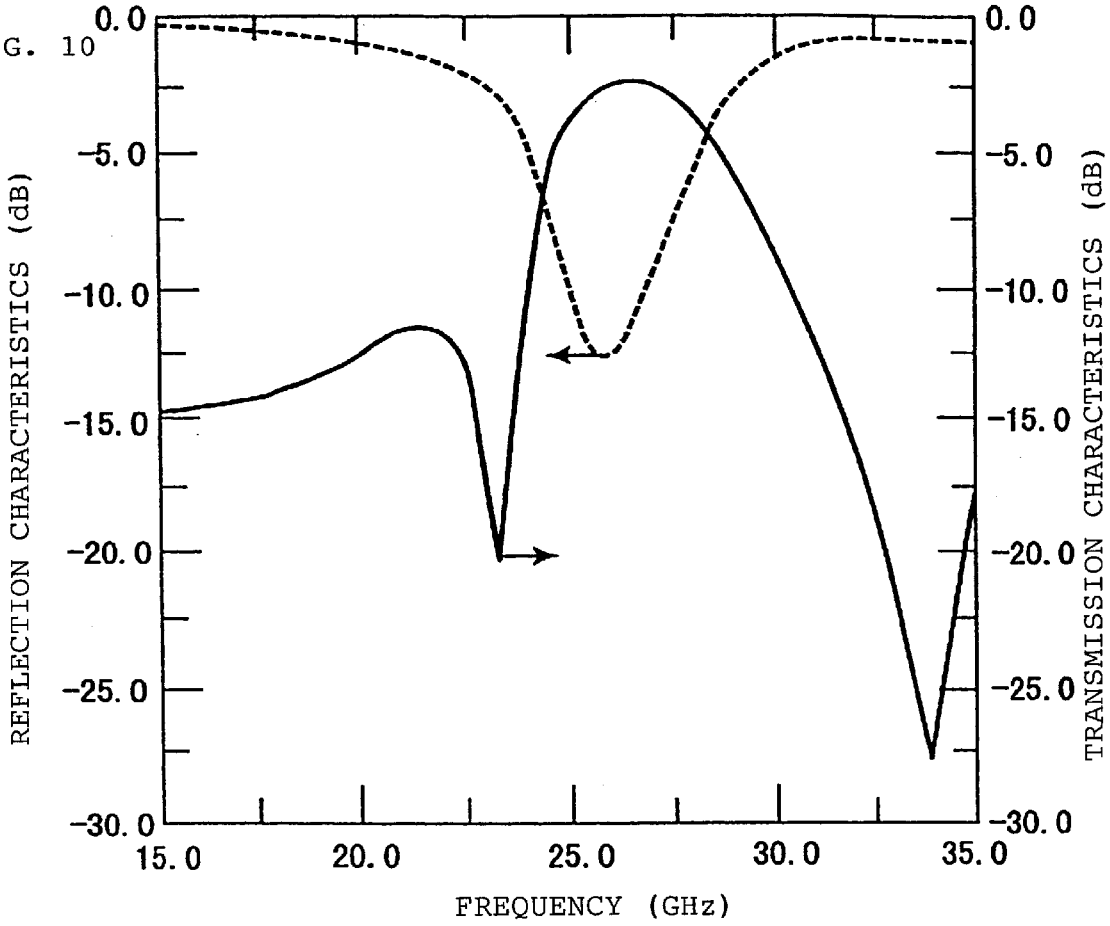
FIG. 10 is a graph showing the frequency characteristics of a dual-mode bandpass filter according to the second preferred embodiment of the present invention.

The frequency characteristics of the dual-mode bandpass filter according to the second preferred embodiment shown in FIG. 9 are shown in FIG. 10. As shown in FIG. 10, also in the second preferred embodiment, it is understood that bandwidth for a dual-mode bandpass filter is obtained by providing a capacitor using the via hole electrode 7. When comparing each type of characteristics with the solid lines A and B in FIG. 5, it is understood that the pass-band width can be adjusted by changing the number of capacitors.

Figure 11:
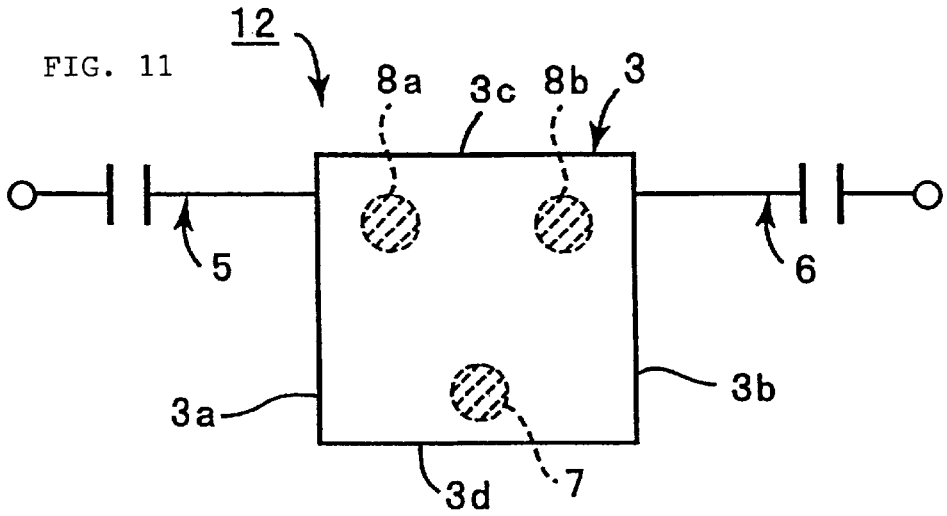
FIG. 11 is a schematic plane figure showing the main portion of a dual-mode bandpass filter according to a third preferred embodiment of the present invention.

FIG. 11 is a schematic plane figure illustrating a dual-mode bandpass filter according to a third preferred embodiment of the present invention and corresponds to FIG. 2 showing the first preferred embodiment.

In a dual-mode bandpass filter 12 according to the third preferred embodiment, three via hole electrodes 7, 8*a*, and 8*b* are arranged to oppose a metal film 3. Other points are similar to the first preferred embodiment.

Figure 12:
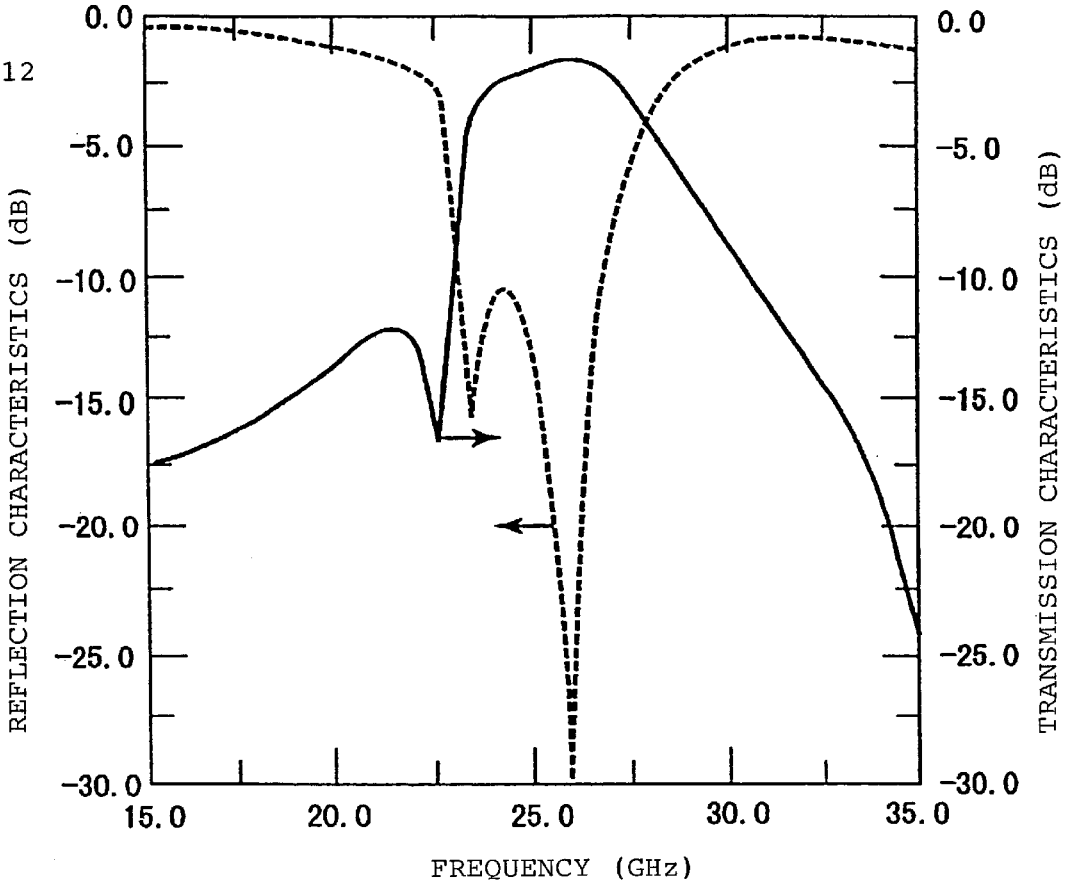
FIG. 12 is a graph showing the frequency characteristics of a dual-mode bandpass filter according to the third preferred embodiment of the present invention.

The frequency characteristics of the dual-mode bandpass filter 12 obtained when the via hole electrodes 8*a* and 8*b* have substantially the same size as that of the via hole electrode 7 are shown in FIG. 12.

As is clear from FIG. 12, also in the third preferred embodiment, it is understood that dual-mode-bandpass-filter characteristics are obtained such that a metal film 3 is provided with capacitors based on three via hole electrodes 7, 8*a*, and 8*b* so that two resonant modes are coupled. As is clear from the comparison of the frequency characteristics of the first and second preferred embodiments shown in FIGS. 5 and 10 with the frequency characteristics of the third preferred embodiment shown in FIG. 12, it is understood that by increasing the number of via hole electrodes, the passband width can be adjusted.

Figure 13:
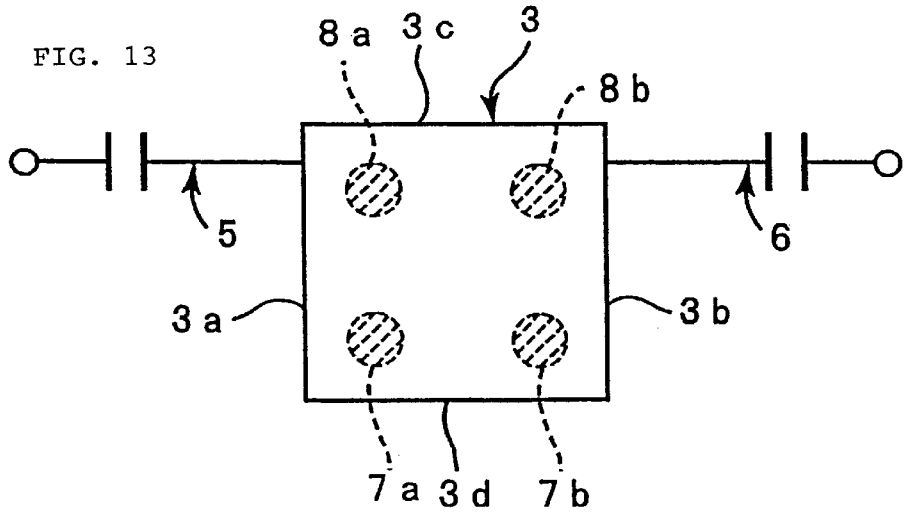
FIG. 13 is a schematic plane figure showing the main portion of a dual-mode bandpass filter according to a fourth preferred embodiment of the present invention.

Similarly, FIG. 13 is a schematic plane figure illustrating a dual-mode bandpass filter according to a fourth preferred embodiment of the present invention and corresponds to FIG. 2 showing the first preferred embodiment. In the fourth preferred embodiment, four via hole electrodes 7*a*, 7*b*, 8*a*, and 8*b* are disposed. The via hole electrodes 7*a*, 7*b*, 8*a*, and 8*b* preferably have dimensions similar to those of the via hole electrode 7 in the first preferred embodiment. The frequency characteristics of the dual-mode bandpass filter 13 are shown in FIG. 14.

Figure 14:
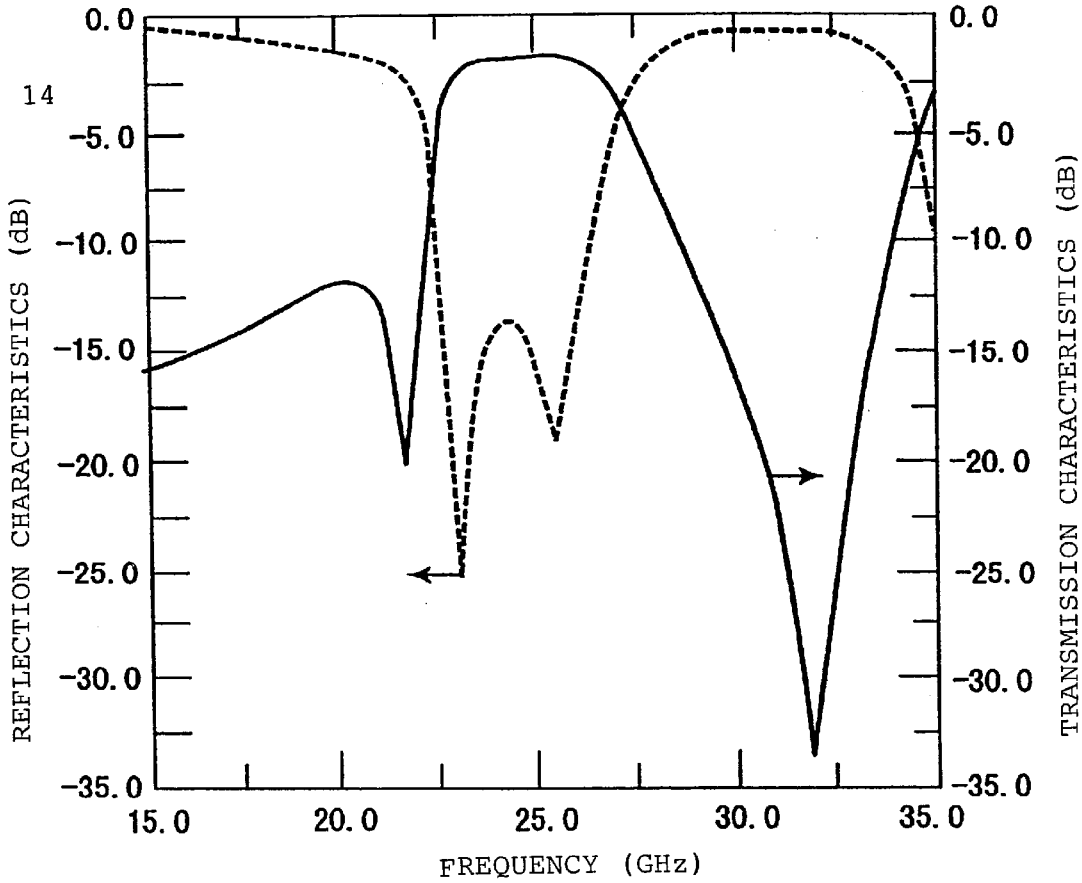
FIG. 14 is a graph showing the frequency characteristics of a dual-mode bandpass filter according to the fourth preferred embodiment of the present invention.

As is clear from FIG. 14, also in the fourth preferred embodiment, two resonant modes are coupled by provision of capacitance, whereby characteristics for a dual-mode bandpass filter are obtained.

As is clear from the comparison of the frequency characteristics of the preferred embodiments shown in FIGS. 5, 10, and 12 with the frequency characteristics shown in FIG. 14, it is understood that by changing the number of via hole electrodes, the pass-band width can be adjusted.

Figure 15:
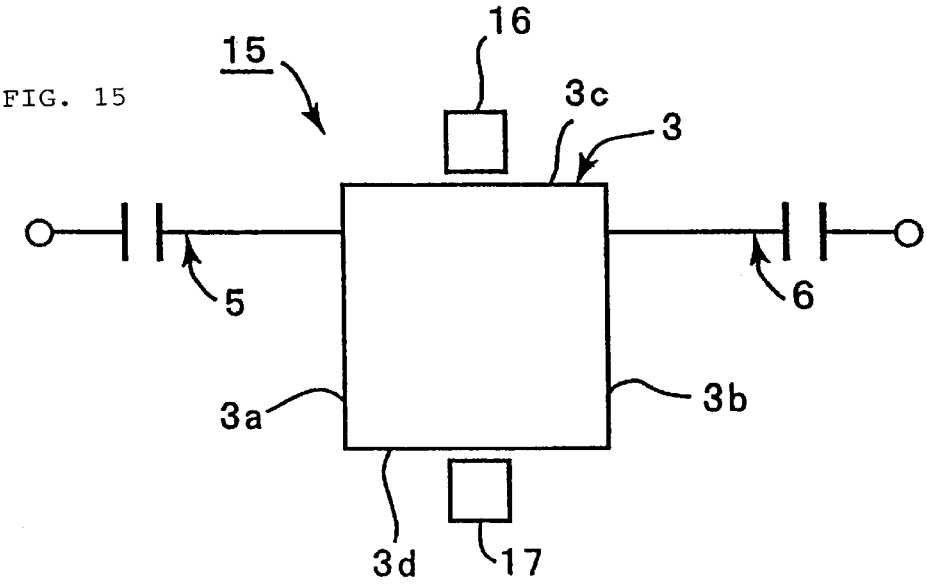
FIG. 15 is a schematic plane figure showing the main portion of a dual-mode bandpass filter according to a fifth preferred embodiment of the present invention.

FIG. 15 is a schematic plane figure illustrating a dual-mode bandpass filter according to a fifth preferred embodiment of the present invention and corresponds to FIG. 2 showing the first preferred embodiment.

In a dual-mode bandpass filter 15 according to the fifth preferred embodiment, a capacitor applied to a metal film 3 is defined not by a via hole electrode provided in a dielectric substrate but by capacitance lead-out electrodes 16 and 17 disposed in one plane with the metal film 3. The capacitance lead-out electrodes 16 and 17 are constituted by, on the surface of the dielectric substrate, opposite sides 3*c* and 3*d* of a metal film 3 and substantially rectangular metal films provided across predetermined gaps. In the first preferred embodiment, the capacitance lead-out electrodes 16 and 17 are opposed across the sides 3*c* and 3*d* and approximate 150-$\mu$m gaps so as to have a length of about 1400$\mu$m. Since other features of the structure are similar to those of the dual-mode bandpass filter 1 according to the first preferred embodiment, a detailed description is omitted to avoid repetition.

Figure 16:
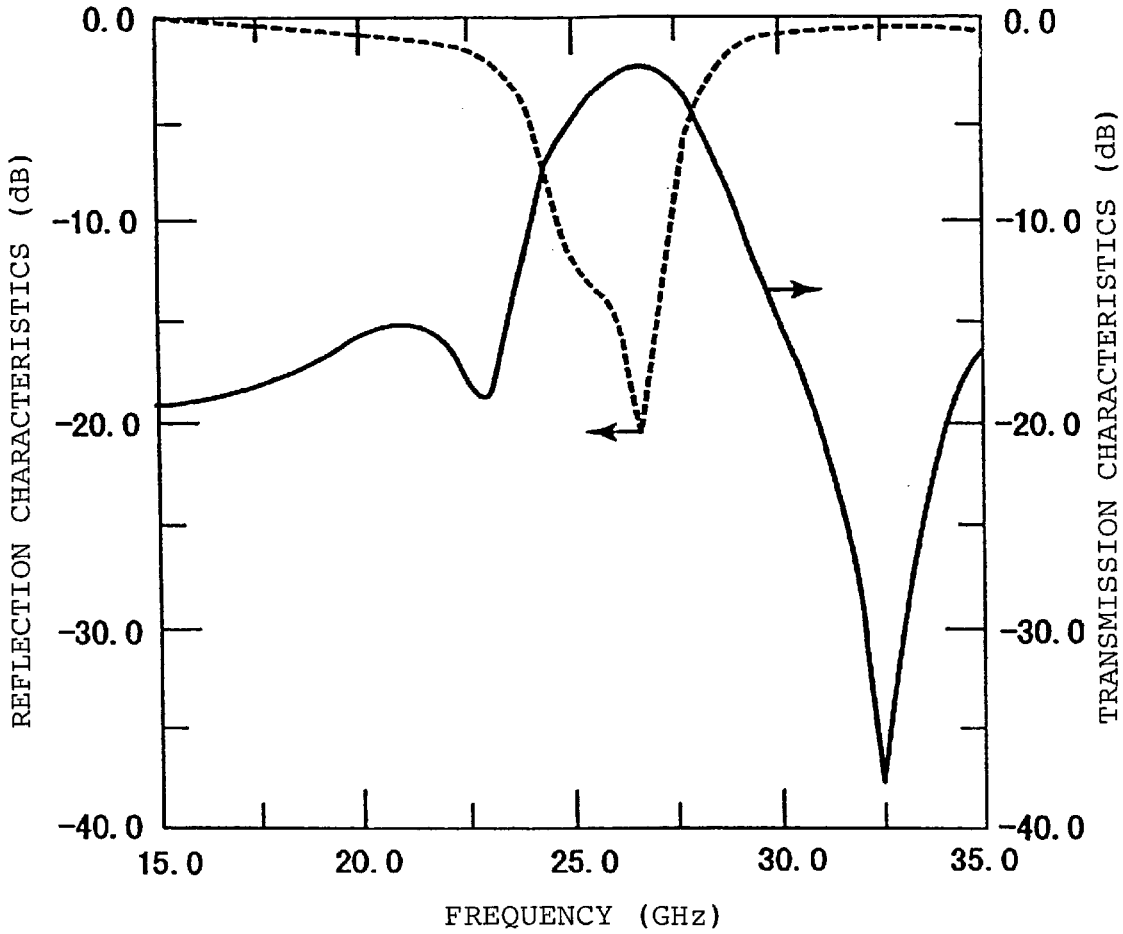
FIG. 16 is a graph showing the frequency characteristics of a dual-mode bandpass filter according to the fifth preferred embodiment of the present invention.

The frequency characteristics of a dual-mode bandpass filter 15 according to the fifth preferred embodiment are shown in FIG. 16.

As is clear from FIG. 16, it is understood that also in the fifth preferred embodiment, dual-mode-bandpass-filter characteristics are obtained such that the metal film 3 is provided with the capacitance based on the capacitance lead-out electrodes 16 and 17 so that two resonant modes are coupled.

In the fifth preferred embodiment, the capacitance lead-out electrodes 16 and 17 are defined by a metal film disposed on the surface of the dielectric substrate. Accordingly, in a process similar to that for forming the metal film 3, the capacitance lead-out electrodes 16 and 17 can easily be formed.

Since the capacitance lead-out electrodes 16 and 17 are disposed on the surface of the dielectric substrate, the capacitance provided to the metal film 3 can easily be adjusted by trimming the capacitance lead-out electrodes 16 and 17.

Also in the fifth preferred embodiment, positions at which input/output coupling circuits 5 and 6 are coupled to the metal film 3 do not always need to have a central angle of 90 degrees. Moreover, by changing the magnitude of the capacitance applied to the capacitance lead-out electrodes 16 and 17 and the positions of the capacitance lead-out electrodes 16 and 17, in other words, by changing the capacitor arrangement so that the resonant electric field of a portion for generating a strong resonant electric field is weakened, the pass-band width can easily be adjusted.

Although in the fifth preferred embodiment the capacitance lead-out electrodes 16 and 17 are provided, when the metal film 3 is disposed in the dielectric substrate, the capacitance lead-out electrodes 16 and 17 may be opposed to each other on a layer different from the metal film 3, with the metal film 3 and the dielectric substrate layer provided therebetween. In the dielectric substrate, the metal film 3 and the capacitance lead-out electrodes 16 and 17 may be formed in a plane at the same level, similarly to the first preferred embodiment.

Although in the first to fifth preferred embodiments, each metal film 3 has a substantially square shape, the plane shape of the metal film 3 is not particularly limited in order to constitute a resonator in the dual-mode bandpass filter in the present invention.

Figure 17:
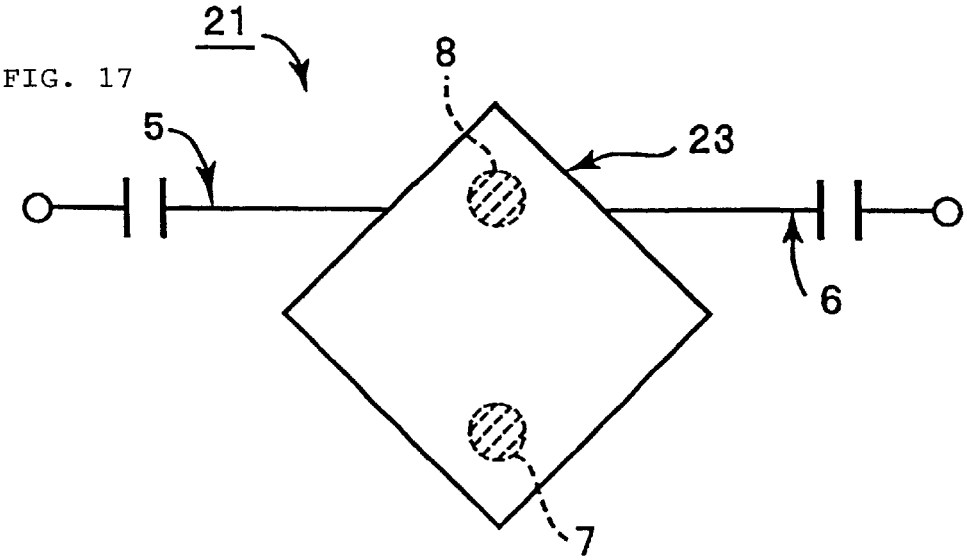
FIG. 17 is a schematic plane figure showing the main portion of a dual-mode bandpass filter according to a sixth preferred embodiment of the present invention.

FIG. 17 is a schematic plane figure illustrating a dual-mode bandpass filter according to a sixth preferred embodiment of the present invention and corresponds to FIG. 2 showing the first preferred embodiment. In a dual-mode bandpass filter 21 according to the sixth preferred embodiment, the plane shape of a metal film 23 is rhombic. Since other points are similar to those in the first preferred embodiment, a detailed description is omitted to avoid repetition.

Figure 18:
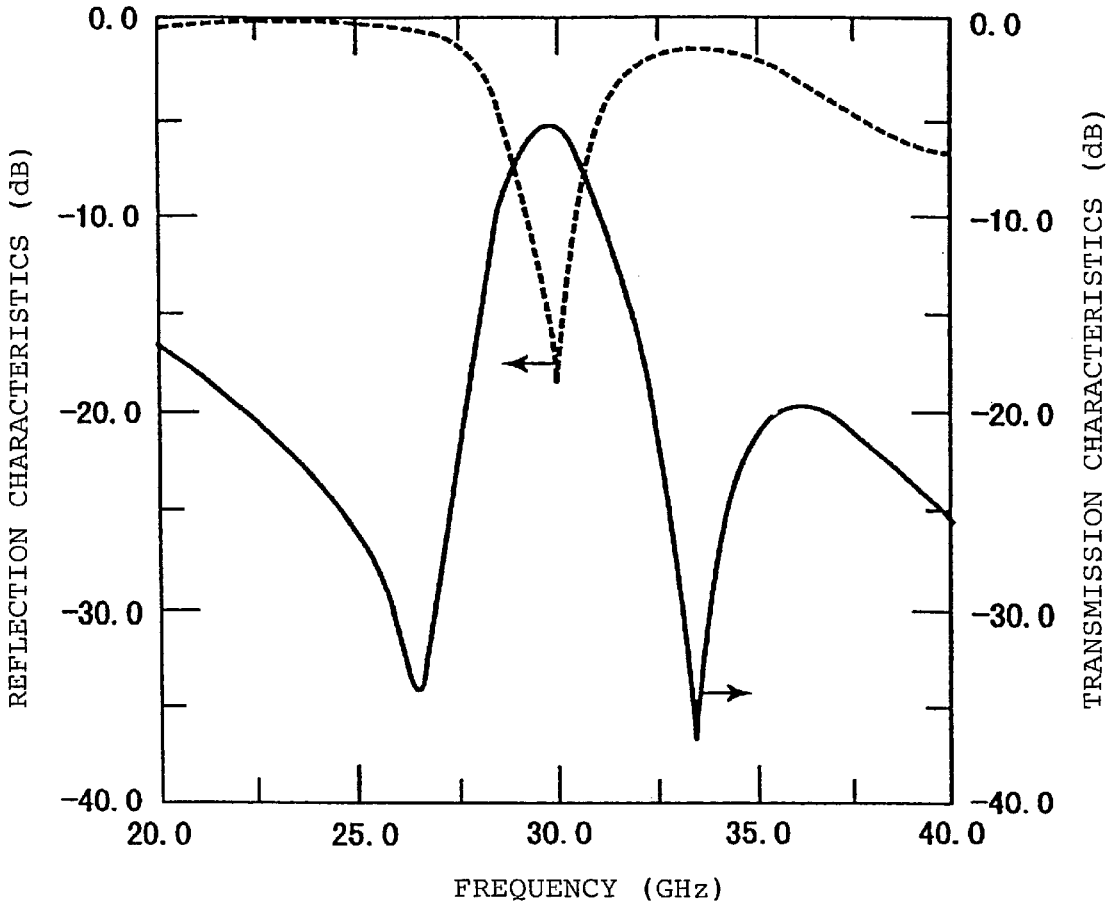
FIG. 18 is a graph showing the frequency characteristics of a dual-mode bandpass filter according to a sixth preferred embodiment of the present invention.

A dual-mode bandpass filter was formed similarly to the first preferred embodiment, with the size of the rhombic metal film 3 set at about 1700 $\mu$m. The frequency characteristics thereof are shown in FIG. 18. As is clear from FIG. 18, also in the sixth preferred embodiment, the capacitance generated by the via hole electrodes 7 and 8 are provided to the metal film 3. Thus, the resonant frequency of one resonant mode is shifted to couple the two resonant modes, whereby dual-mode-bandpass-filter characteristics are obtained.

As is estimated from the first to fourth preferred embodiments, also in the sixth preferred embodiment, by changing the magnitude of the provided capacitance and the capacitor positions, the pass-band width can easily be adjusted.

Figure 19:
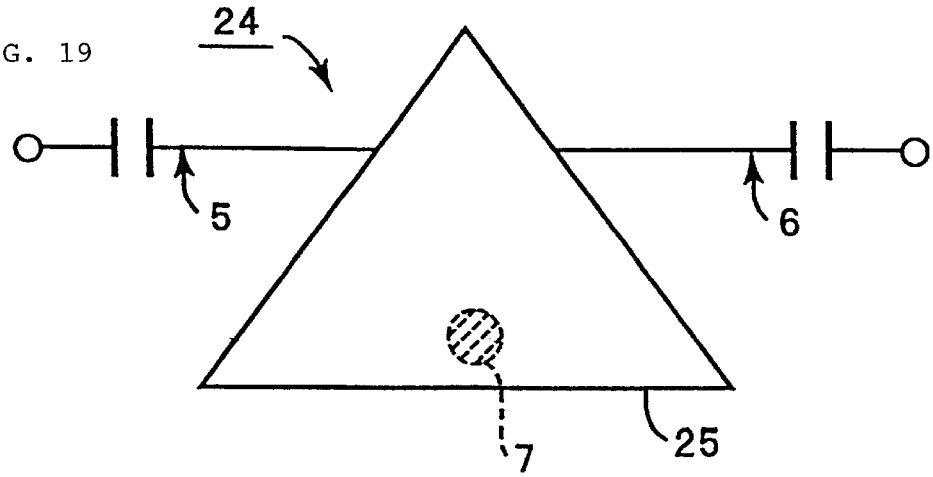
FIG. 19 is a schematic plane figure showing the main portion of a modification of a dual-mode bandpass filter of preferred embodiments of the present invention.
Figure 20:
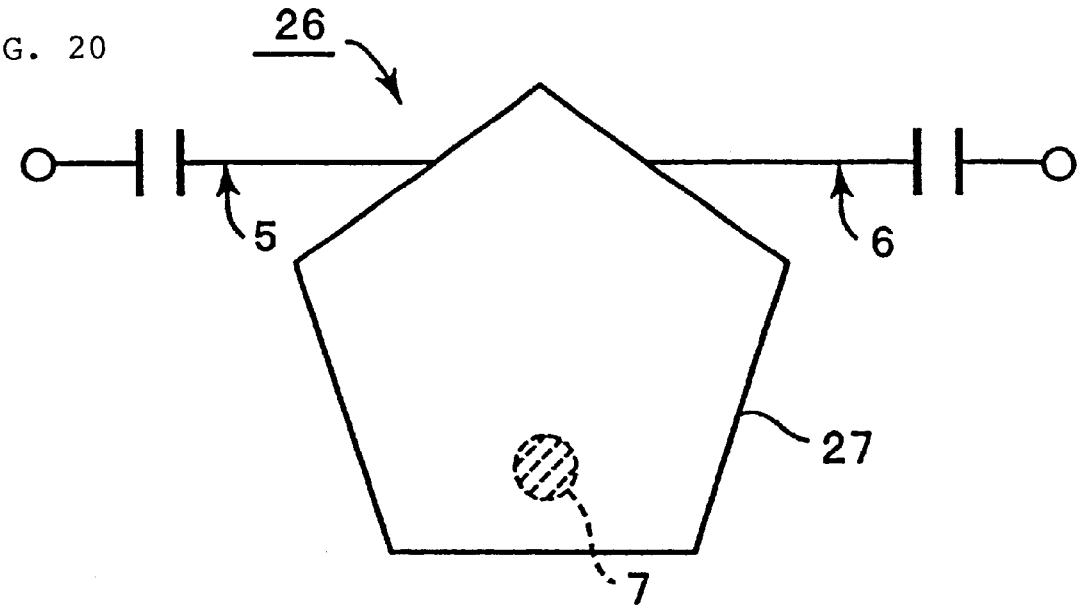
FIG. 20 is a schematic plane figure showing the main portion of another modification of a dual-mode bandpass filter of preferred embodiments of the present invention.
Figure 21:
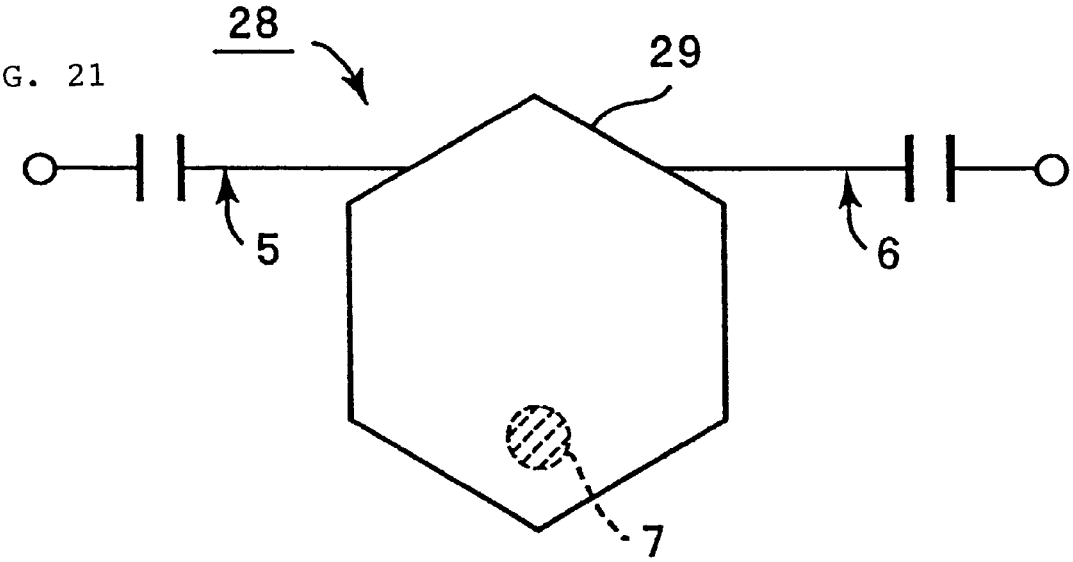
FIG. 21 is a schematic plane figure showing the main portion of another modification of a dual-mode bandpass filter of preferred embodiments of the present invention.
Figure 22:
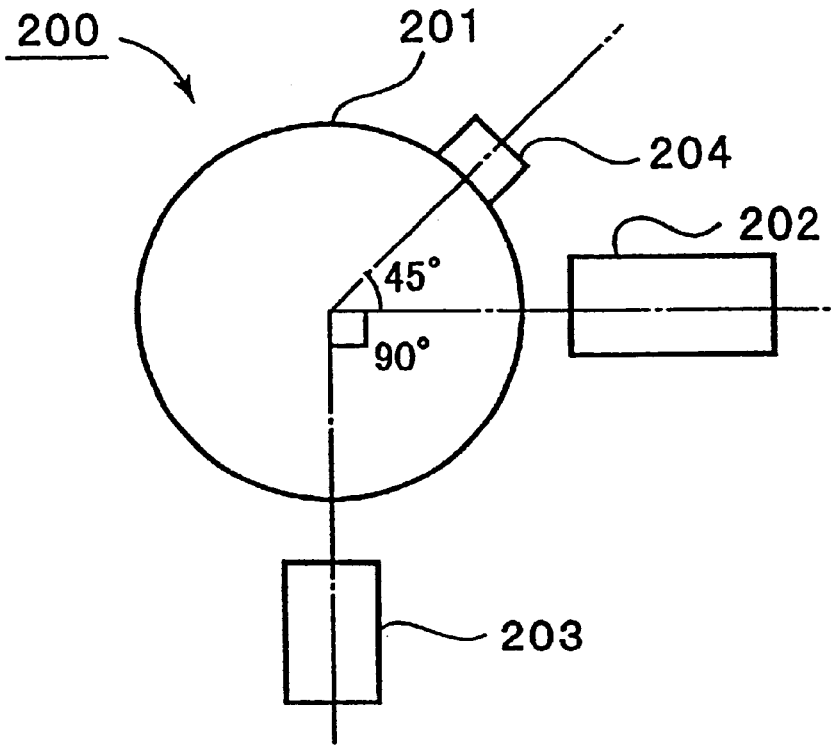
FIG. 22 is a schematic plane figure showing the main portion of a conventional dual-mode bandpass filter.
Figure 23:
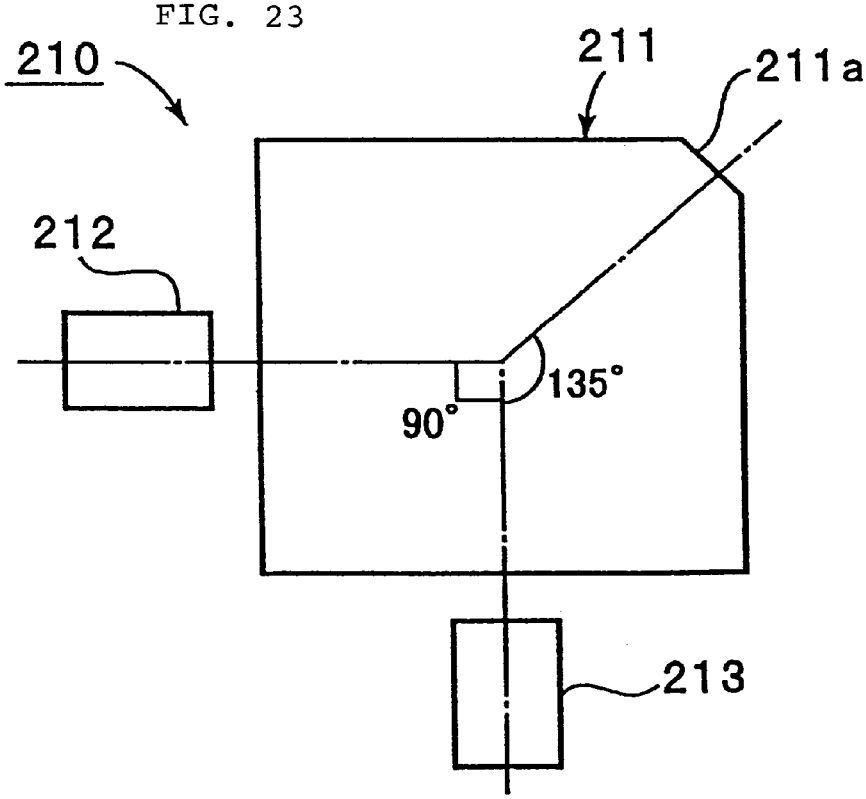
FIG. 23 is a schematic plane figure showing the main portion of another example of a conventional dual-mode bandpass filter.

FIGS. 19 to 21 are schematic plane figures showing modifications of the dual-mode bandpass filter of preferred embodiments of the present invention and corresponds to FIG. 2 showing the first preferred embodiment.

In a dual-mode bandpass filter 24 shown in FIG. 19, a metal film 25 having a substantially triangular plane shape is preferably used, in a dual-mode bandpass filter 26 of a modification shown in FIG. 20, a metal film 27 having a substantially equilateral-pentagonal plane shape is preferably used, and in a dual-mode bandpass filter 28 of a modification shown in FIG. 21, a metal film 29 having a substantially equilateral-hexagonal plane shape is preferably used.

As described above, the plane shape of the metal film can be changed, as required, and in addition to these polygonal shapes, ellipses, and asymmetric and irregular plane shapes may be used. In the above-described preferred embodiments, the metal film for constituting the resonator on the upper surface of the dielectric substrate is provided but the metal film may be embedded in the dielectric substrate.

The ground electrode 4 may also be embedded in the inside of the dielectric substrate 2.

Figure 24:
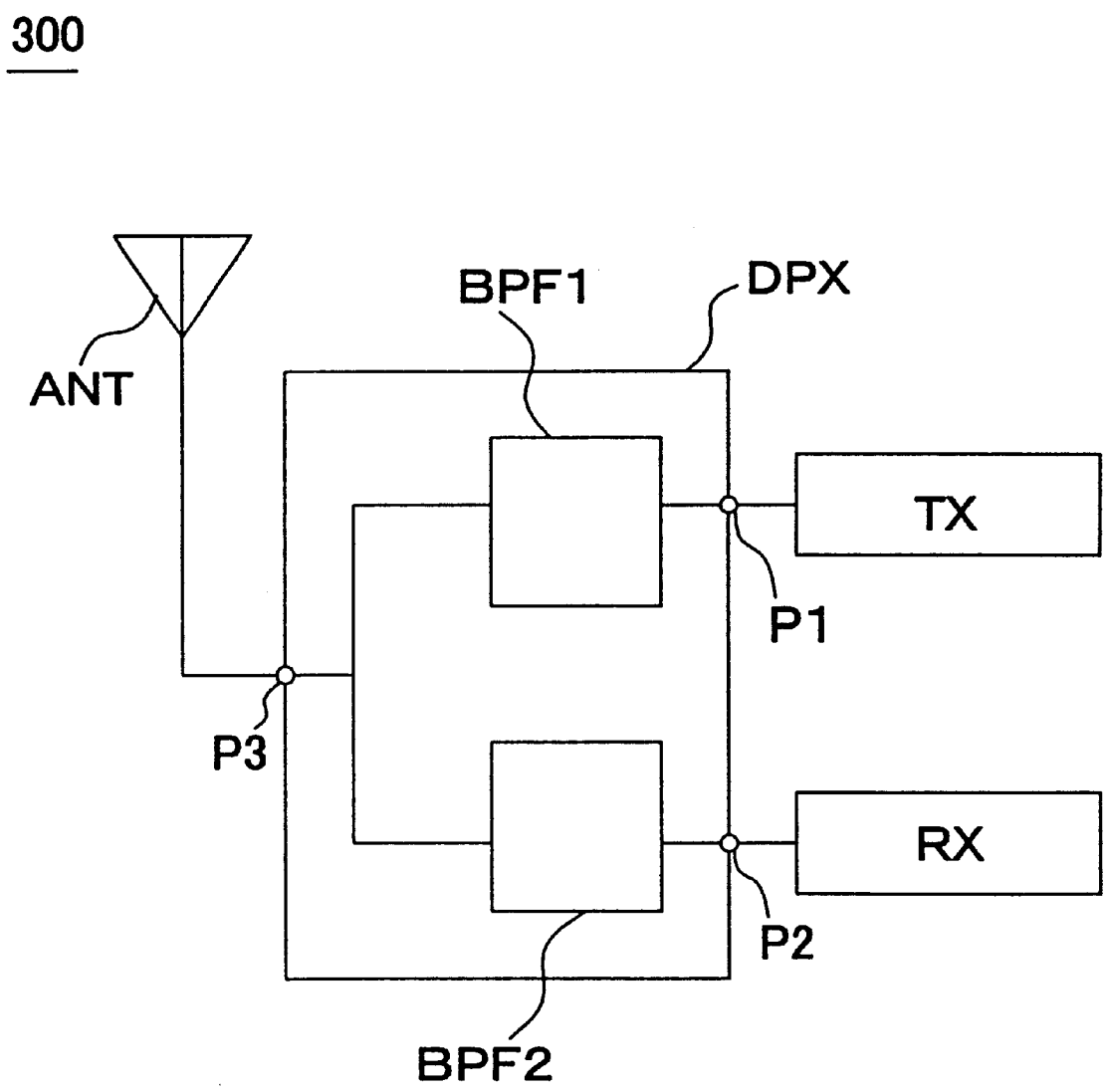
FIG. 24 is an electric circuit block diagram of an antenna sharing device and a front-end portion of a communication device according to a preferred embodiment of the present invention.

Next, FIG. 24 is an electric circuit block diagram of the RF part of a communication device 300. In FIG. 24, an antenna ANT, an antenna shearing device DPX, a transmission side circuit TX, a reception side circuit RX are shown.

Furthermore, the antenna shearing device DPX has three ports for input/output signals, wherein the first port P1 is connected to the transmission side circuit TX, the second port P2 is connected to the reception side circuit RX and the third port P3 is connected to the antenna ANT. Here, the antenna shearing device DPX includes two dual-mode bandpass filter BPF1 and BPF2, and as the dual-mode bandpass filters BPF1 and BPF2, above-described band-pass filter can be used. The dual-mode bandpass filter BPF1 is provided between the first port P1 and the third port P3, the dual-mode bandpass filter BPF2 is provided between the second port P2 and the third port P3.

In this communication device including the antenna shearing device, because the capacitance of the dual-mode bandpass filter can easily be adjusted, the bandwidth of the communication device can easily be adjusted and it can be provided in degree of design freedom.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A dual-mode bandpass filter comprising:

a dielectric substrate including two main surfaces;

a metal film disposed on one of the main surfaces of said dielectric substrate or within said dielectric substrate;

a ground electrode disposed in said dielectric substrate or on one of the main surfaces of said dielectric substrate so as to oppose said metal film, with at least a portion of said dielectric substrate provided therebetween;

first and second input/output coupling circuits coupled to said metal film; and at least one capacitor loaded to said metal film so that when an input signal is applied from one of the first or second input/output coupling circuits, two resonant modes generated in said metal film are coupled.

2. The dual-mode bandpass filter according to claim 1, wherein the capacitor is provided in a portion of said metal film in which a resonant electric field that is relatively stronger than that of the remaining portion of said metal film is generated.

3. The dual-mode bandpass filter according to claim 2, wherein the capacitor includes a capacitance lead-out electrode which is connected to said ground electrode and which is disposed in said dielectric substrate, and said portion of said dielectric substrate and said capacitance lead-out electrode and said metal film have a capacitance therebetween.

4. The dual-mode bandpass filter according to claim 3, where said capacitance lead-out electrode includes a via hole electrode.

5. The dual-mode bandpass filter according to claim 4, wherein said capacitance lead-out electrode further includes a counter-electrode film disposed at an end of the via hole electrode and which is provided in the dielectric substrate so as to oppose said metal film.

6. The dual-mode bandpass filter according to claim 1, wherein a plane shape of said metal film is one of substantially rectangular, substantially rhombic, and substantially polygonal.

7. The dual-mode bandpass filter according to claim 1, wherein the dielectric substrate is made of ceramic material having a dielectric constant $\in r=6.27$.

8. The dual-mode bandpass filter according to claim 1, wherein said metal film has a substantially rectangular shape.

9. The dual-mode bandpass filter according to claim 1, wherein the ground electrode is arranged to cover the entire surface of the lower surface of the dielectric substrate.

10. The dual-mode bandpass filter according to claim 1, further comprising via hole electrodes defining capacitance lead-out electrodes that are substantially perpendicular to the metal film.

11. The dual-mode bandpass filter according to Claim 10, wherein one of the via hole electrodes is electrically connected to the ground electrode.

12. The dual-mode bandpass filter according to claim 10, wherein each of the via hole electrodes has a substantially circular shape.

13. The dual-mode bandpass filter according to claim 10, where in the via hole electrodes are arranged to provide the metal film with capacitance.

14. The dual-mode bandpass filter according to claim 10, wherein the via hole electrodes are arranged to cause the two resonant modes to be coupled.

15. The dual-mode bandpass filter according to claim 1, wherein the two resonant modes have different resonant frequencies.

16. The dual-mode bandpass filter according to claim 1, wherein positions at which the input/output coupling circuits are coupled to the metal film do not define a central angle of 90 degrees with respect to the center of the metal film.

17. An antenna sharing device including the dual-mode bandpass filter of claim 1.

18. A communication device including the dual-mode bandpass filter of claim 1.

19. A communication device including the antenna sharing device of claim 17.

* * * * *